United States Patent [19]

Hoschett

[11] 4,407,556

[45] Oct. 4, 1983

[54] RETAINING CLIP FOR AN ELECTRICAL CONNECTOR

[75] Inventor: Albert M. Hoschett, Arlington Heights, Ill.

[73] Assignee: Teletype Corporation, Skokie, Ill.

[21] Appl. No.: 304,297

[22] Filed: Sep. 21, 1981

[51] Int. Cl.[3] ..... H01R 13/627

[52] U.S. Cl. ..... 339/91 R; 339/17 LC; 339/75 P

[58] Field of Search ..... 339/17 LC, 75 P, 91 R

[56] References Cited

U.S. PATENT DOCUMENTS

| | | | |
|---|---|---|---|
| 1,835,251 | 12/1931 | Wetstein | 339/91 R |
| 2,434,521 | 1/1948 | Savage | 339/75 P |
| 2,753,536 | 7/1956 | Tjader | 339/75 P |
| 3,005,176 | 10/1961 | Berg | 339/75 P |
| 3,573,706 | 4/1971 | Haberlen | 339/91 R |

FOREIGN PATENT DOCUMENTS

| | | | |
|---|---|---|---|
| 7705393 | 11/1977 | Netherlands | 339/91 R |

OTHER PUBLICATIONS

IBM Tecnical Disclosure Bulletin, vol. 22, No. 3, 8/1979, "Cable Paddle Card Restraint", J. J. Best.

IBM Tecnical Disclosure Bulletin, vol. 21, No. 5, 10/1978, "Connector Retainer", M. L. Cahill.

*Primary Examiner*—John McQuade

*Attorney, Agent, or Firm*—W. K. Serp; J. C. Albrecht

[57] ABSTRACT

A clip 12 for releasably holding a socket 22 in engagement with a plug 14 soldered to a circuit board 19 is described. The clip 12 includes a pair of legs 30 spaced the width of the plug. Adjacent ends of the legs 30 define locking prongs 34 for engaging the plug 14 and the remaining ends of the clip have opposing notches 41 for engaging the socket. A brace 32 holds the legs in alignment. The brace 32 includes a pair of arms 44 which limit relative movement of the clip 12 with respect to the circuit board 19. A pair of opposing fingers 48 define an access opening 50 in combination with the circuit card to facilitate alignment between the plug 14 and socket 22.

2 Claims, 4 Drawing Figures

RETAINING CLIP FOR AN ELECTRICAL CONNECTOR

DESCRIPTION

TECHNICAL FIELD

This invention relates to a retaining clip for securely holding an electrical connector socket and a mating plug in engagement.

BACKGROUND ART

Frequently, printed circuit boards are connected by socket terminated cables. The socket is mated with a plug soldered on the circuit board. Such circuit boards are subject to occasional vibration and other undesired movement which may cause the connectors to loosen and ultimately become disconnected. An additional problem encountered with such interconnect cabling is the possibility that the plug and socket forming the connection will not be in the desired alignment when mated thus resulting in malfunction or damage to the circuitry mounted on the circuit board.

DISCLOSURE OF THE INVENTION

A clip is disclosed for releasably holding an electrical connector socket in engagement with a plug securely soldered to a circuit board having first and second surfaces. The plug consists of at least two spaced pins maintained in relative position by a molded strip. The pins are bent at right angles and soldered to the circuit board and positioned so that the axes of the free ends of the pins extend parallel to and along the first surface of the circuit board. The clip includes a pair of generally parallel elongated legs each spaced approximately the width of the plug and each having first and second ends. A brace secured to each of the legs serves to hold the legs in relative alignment. The first end of each of the legs include means for engaging the plug and each second end has means for engaging the socket.

Preferably, the brace includes arms extending along and parallel to the axis of the legs for engaging the second surface of the circuit board thereby limiting relative movement between the clip and the circuit board.

Additionally, the clip includes a prong on each of the first ends of the legs with the prongs being oppositely positioned to grasp the molded strip of the plug. The second ends of the legs are flared to define camming surfaces which facilitate movement of the legs apart to allow engagement between the socket and the plug. The first end of each leg has a notch with the notches being oppositely disposed and serving to engage the socket to prevent disengagement of the socket from the plug.

THE DRAWING

DETAILED DESCRIPTION

Figure 1:
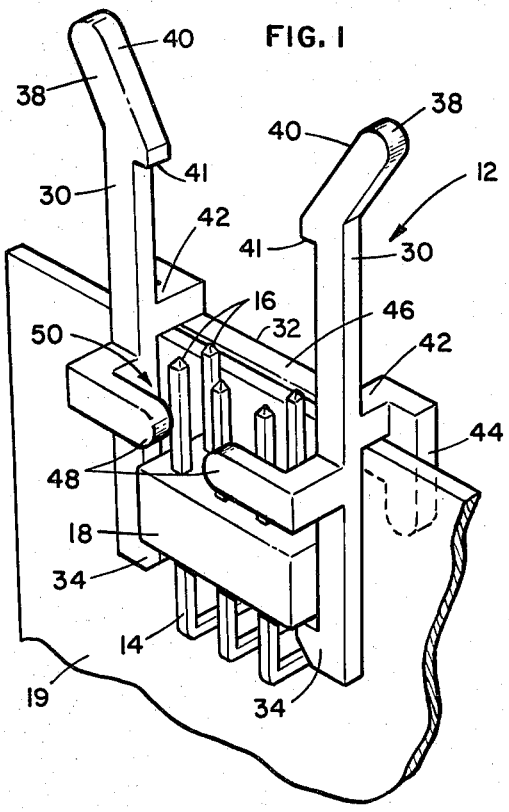
FIG. 1 is a perspective view of a clip in combination with a connector plug mounted to a circuit board.
Figure 2:
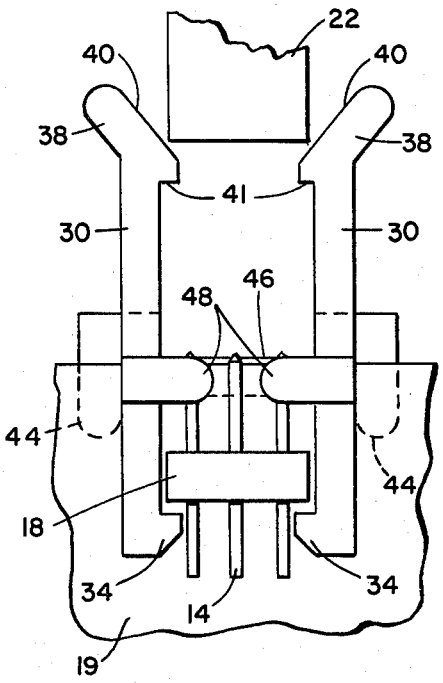
FIG. 2 is a front plan view of the apparatus of FIG. 1 in combination with a connector socket prior to engagement of the socket with the plug.
Figure 3:
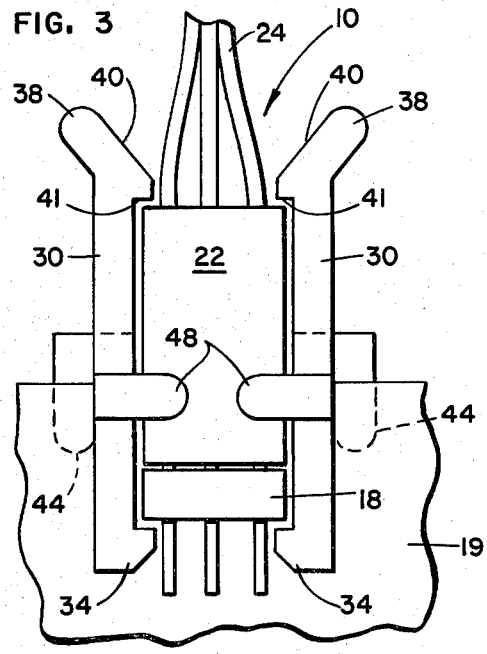
FIG. 3 is a front plan view similar to FIG. 2 with the connector plug and socket in engagement.
Figure 4:
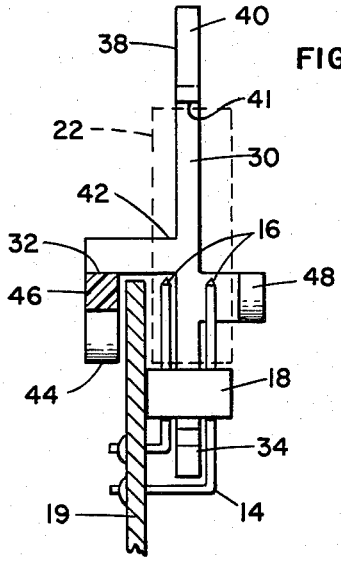
FIG. 4 is a side view of the apparatus of FIG. 3 with the connector socket shown in phantom to more clearly illustrate the features of this invention.

As illustrated, a connector 10 with which clip 12 is designed to cooperate includes a plug 14 having two parallel rows of pins 16. The pins 16 are maintained in spaced parallel orientation by a molded plastic insulation strip 18 and soldered to a circuit board 19. The plug 14 is adapted to mate with a socket 22 to which a cable 24 is connected. Suitable connectors are manufactured and sold by Berg Electronics, a Division of DuPont Corporation, under the trademark "BergStik" and are described in their brochure "Panel Products 500 Bulletin".

The clip 12 is molded of nylon or other yieldable insulating material and includes a pair of substantially parallel elongated legs 30 connected by means of a cross brace 32. The legs 30 are rectangular in cross-section. The ends of the legs 30 define inwardly projecting locking prongs 34 which serve to engage the insulating strip 18 of the plug 14 and thus hold the clip 12 secured to the plug 14 as will subsequently be more fully appreciated. The opposite ends of the legs 30 are flared outwardly as at 38 and define camming surfaces 40 which facilitate insertion and removal of the socket 22. Additionally, the inner surface of the legs 30, adjacent the flared ends thereof, define opposing notches 41. The notches 41 engage the end of the socket 22 to prevent unintentional disconnection from the plug 18. As illustrated, the brace 32 is positioned in approximately the center of the legs 30 and includes a pair of spacing members 42 having a thickness slightly greater than the thickness of the circuit card with which the clip is to be used. Extending parallel to the legs 30 and secured to the spacing members 42 are a pair of arms 44. The arms extend toward the plug locking prongs 34 and parallel to the axis of the legs 30. Extending transverse to the axis of the legs is an elongated support member 46.

Extending from the side of the legs 30 opposite the spacing members 42 are a pair of elongated fingers 48. The fingers 48 are in alignment along a common axis and cooperate with the circuit board 19 to define an access opening 50 which assures alignment between the socket 22 and the plug 14 during engagement.

In use, the plug 14 is soldered to the circuit board 19 manually or by flow soldering techniques well known in the art. In the installation of the clip 12, the flared ends 38 of the clip 12 are manually grasped and urged slightly toward each other causing the locking prongs 34 at the opposite end of the legs 30 to further separate. This condition occurs as the legs 30 pivot slightly about the brace 32. The prongs 34 are moved over the molded strip 18 of the plug. Once the clip 12 is positioned, the flared ends 38 are released, and due to the resiliency of the material from which the clip 12 is molded, the prongs 34 move together securely engaging the molded strip 18 of the plug 14. A particular feature of the clip 12 is that it may be installed after the various components, as well as the pins 14, are soldered to the circuit board 19. Thus, components may be flow soldered to the circuit board 19 and the clip 12 subsequently installed.

Engagement between the socket 22 and the plug 14 is accomplished by engaging the socket 22 with the camming surfaces 40 and forcing the socket toward the plug 14. As the socket 22 rides along the camming surfaces 40, the legs 30 are forced part allowing the socket 22 to pass between the locking notches and into engagement with the plug 14. The access opening 50 defined by the circuit card and the opposing fingers 48 assures that the plug 14 and socket 22 will be maintained in the desired alignment prior to engagement. Once the socket 22 and plug 14 are engaged, the locking notches 41 pass over the end of the socket 22 thus preventing accidental removal of the socket 22. The sides of the socket maintain the legs 30 in a parallel alignment assuring that the locking prongs 34 will engage the molded strip 18 of the plug 14. Removal of the socket 22 is accomplished by forcing the flared ends 40 of the legs 30 apart so that the notches 41 no longer engage the socket 22. Thereafter, the socket 22 and plug 14 are separated.

What is claimed is:

1. A retaining clip (12) for releasably holding an electrical connector socket (22) in engagement with a plug (14) securely soldered to a circuit board (19) having first and second surfaces; the plug (14) comprises at least two spaced parallel pins (16) maintained in relative position by a molded strip (18), the pins (16) are bent at right angles with one end of each pin soldered to the circuit board (19) and the free corresponding ends of the pins (16) being in a plane parallel to the first surface of the circuit board (19), said retaining clip (12) comprises:

a pair of generally parallel, elongated legs (30) having first and second ends, each of said legs (30) being spaced apart approximately the width of said plug (14), a brace (32) secured to each of said legs (30) spaced apart from both ends thereof and serving to hold said legs (30) in substantially parallel alignment, said first ends of said legs (30) each having a locking prong (34), said locking prongs (34) being oppositely positioned to grasp the molded strip (18) of said plug (14), said second ends of said legs (30) having notches (41), opposingly disposed and serving to engage the socket (22) to prevent disengagement of the socket (22) from the plug (14), said second end of each of said legs (30) is flared (38) forming a camming surface (40) which serves to facilitate movement of said legs (30) apart to allow engagement between said socket (22) and said plug (14), and said brace (32) includes a pair of arms (44) secured to said legs (30) and extending in a common direction substantially along a line parallel to the axis of each of the legs (30) and along a second surface of the circuit board (19) and serving to restrict relative movement between said retaining clip (12) and said circuit board (19).

2. The clip of claim 1 wherein said legs (30) each carry generally medially disposed, opposing fingers (48) which define an access opening (50) in combination with the first surface of the circuit board (19) thereby facilitating alignment between the plug (14) and the socket (22).

* * * * *